US005261539A

United States Patent [19]

Hancock et al.

[11] Patent Number: 5,261,539

[45] Date of Patent: Nov. 16, 1993

[54] FLOTATION PROCESS FOR PURIFYING CALCITE

[75] Inventors: Bill A. Hancock, Farmington, Utah; Samuel S. Wang, New Haven, Conn.

[73] Assignee: American Cyanamid Company, Stamford, Conn.

[21] Appl. No.: 957,112

[22] Filed: Oct. 7, 1992

[51] Int. Cl.[5] ..... B03D 1/01; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,177,985 | 10/1939 | Harris | 209/166 |
| 2,365,084 | 12/1944 | Jayne | 209/166 |
| 2,494,132 | 1/1950 | Jayne | 209/166 |
| 3,363,758 | 1/1968 | Cronberg | 209/166 |
| 3,990,966 | 11/1976 | Stanley et al. | 209/12 |
| 4,310,426 | 1/1982 | Smeltz . | |
| 4,340,509 | 7/1982 | Canale . | |
| 4,828,687 | 5/1989 | Hellsten | 209/166 |
| 4,830,739 | 5/1989 | Hellsten | 209/166 |
| 4,995,965 | 2/1991 | Mehaffey | 209/166 |
| 5,124,028 | 6/1992 | Klimpel | 209/166 |

FOREIGN PATENT DOCUMENTS

| | | | |
|---|---|---|---|
| 1100239 | 4/1981 | Canada | 209/166 |
| 1423162 | 9/1988 | U.S.S.R. | 209/166 |

*Primary Examiner*—Thomas M. Lithgow
*Attorney, Agent, or Firm*—Frank M. Van Riet

[57] ABSTRACT

Alkoxylated alkyl amines and alkoxylated alkyl guanidines are excellent collectors when used in mineral froth flotation to remove quartz, micaceous minerals, chlorite, pyrite and other mineral impurities from finely ground calcium carbonate to control tint, color, and abrasiveness.

14 Claims, No Drawings

FLOTATION PROCESS FOR PURIFYING CALCITE

FIELD OF THE INVENTION

The present invention relates to the use of reagents in mineral froth flotation processes to remove mineral impurities from calcite ore, calcite rougher and calcite concentrates. More particularly it relates to the use of alkyoxylated alkyl amines and/or alkoxylated alkyl guanidines as collectors to remove quartz, micaceous minerals, chlorite, pyrite and other mineral impurities from finely ground calcium carbonate to control tint, color, and abrasiveness.

BACKGROUND OF THE INVENTION

The Thompson Weinman process is widely employed to separate impurities from limestone rock. In such a process the mineral bearing rock is subjected to flotation. To effect separation of mineral impurities from calcite, the ground ore is subjected to flotation in the presence of xanthate or tallow amine and/or imidazoline reagents. A particular combination which has been used is a mixture of sodium sec-butyl xanthate and an alcohol type material in amounts of 0.25 to 0.5 pound per ton of calcite ore to float pyrite impurity from the ore. Although such a composition is useful to remove pyrite impurities, it has become common practice to add other flotation reagents such as a combination of N-tallow-trimethylenediamine diacetate and a tertiary amine having one fatty alkyl group and two polyoxyethylene groups attached to nitrogen. This removes, in addition to the pyrites, other insoluble impurities, such as micaceous schist and quartz. These combinations have been found to have certain disadvantages, however, among which are a tendency to promote the corrosion of iron and steel in the reaction vessels leading to brown tints in the calcite pigment and a tendency to act as dispersants for the finely divided calcite in the system, making longer settlement times necessary.

In Stanley et al., U.S. Pat. No. 3,990,966, is described a process in which impurities are separated from calcite by grinding calcite ore, separating the impurities from the calcite by conditioning the ground ore with a cationic flotation reagent selected from the group consisting of 1-hydroxyethyl-2-heptadecenyl glyoxalidine and 1-hydroxyethyl-2-alkylimidazolines and salt derivatives thereof, wherein the alkyl portion of the imidazoline is the alkyl portion of a fatty acid, dry or wet classifying the separated calcite and, if wet, settling the classified calcite in a thickener in the presence of an anionic settling agent. Such a process avoids many of the drawbacks of the prior art, primarily because the normally liquid flotation agents are easier to handle than the solid agents of the prior art and the flotation agents of Stanley et al are much less corrosive.

It has now been discovered that the use of alkoxylated alkyl guanidines and/or alkoxylated alkyl amines in the flotation of the deleterious minerals results in overall higher calcium carbonate recoveries compared to the collectors used in the present state of the art (for example, Stanley et al).

With the reagents of the present invention, flotation may be used to achieve acceptable calcium carbonate product brightness levels for use in filler applications where product brightness is important. Achievement of the calcium carbonate target brightness specification is dependent on the efficient removal, by the collectors (i.e.,flotation agents) of the present invention, of certain minerals, such as micas, feldspars, etc., from the calcium carbonate product. Additionally, removal of silica (quartz) is also desirable and the presently developed reagents remove silica very effectively so as to produce calcium carbonate with lower product abrasiveness and its concomitant deleterious effect on equipment where the final calcium carbonate product is used. Finally, flotation employing the reagents of the present invention affects in a very positive manner the calcium carbonate product's brightness, yellowness and whiteness values. This will be established after consideration of the experimental data hereinafter which compares the effect of the alkoxylated alkyl guanidines and/or alkoxylated alkyl amines on increasing brightness and lowering acid insolubles levels with those of state-of-the-art imidazolines.

SUMMARY OF THE INVENTION

According to the present invention there is provided a reverse flotation process for purifying calcite ore, calcite rougher or calcite concentrate whereby finely ground particles thereof are contacted with a flotation agent and floated to remove quartz, micaceous minerals, chlorite, pyrite and other mineral impurities, the flotation agent consisting essentially of a compound selected from the group consisting of an alkoxylated $C_8$–$C_{24}$ alkyl guanidine containing 1–10 alkoxy groups, an alkoxylated $C_8$–$C_{24}$ alkyl fatty amine containing 1–6 alkoxy groups and mixtures thereof.

In preferred features, the invention contemplates a process as defined above wherein the flotation agent is an alkoxylated $C_8$–$C_{24}$ alkyl guanidine; preferably one in which the flotation agent is an alkoxylated $C_{12}$–$C_{18}$ alkyl guanidine; especially one in which the flotation agent is an ethoxylated $C_{12}$–$C_{18}$ alkyl guanidine. Also among the preferred processes are those wherein the guanidine contains 3–7 alkoxy groups; especially those wherein the guanidine contains 6 alkoxy groups; special mention being made of those wherein the alkoxy groups are ethoxy groups. In another major preferred aspect, the invention contemplates improved processes as first defined above wherein the flotation agent is an alkoxylated $C_8$–$C_{24}$ alkyl amine; those wherein the flotation agent is an alkoxylated $C_{12}$–$C_{18}$ alkyl amine; preferably those wherein the flotation agent is an ethoxylated $C_{12}$–$C_{18}$ alkyl amine; especially preferably those wherein the amine contains 2–5 alkoxy groups; special mention being made of those wherein the amine contains 2 alkoxy groups; particularly those wherein the alkoxy groups are ethoxy groups. Also among the embodiments of the invention are processes as first above defined wherein the flotation agent is a mixture of a guanidine and an amine, of the type specified.

DETAILED DESCRIPTION OF THE INVENTION

The present invention is for use of alkoxylated alkyl guanidine and alkoxylated alkyl amine chemistries for the flotation of the above described deleterious minerals from calcium carbonate, marble in particular. The flotation process used is referred to as reverse flotation (as opposed to direct flotation) where the undesirable constituents are separated into a froth phase and removed from the top of the flotation cell. The flotation machine typically used induces air into a mixed slurry (that had been conditioned with the appropriate reagents) to effect the desired mineral separation. The undesired minerals attach to the air bubbles and rise to the surface where the froth, with the undesirable constituents, are removed from the flotation machine surface.

To save unnecessarily detailed processing description, reference is made to the above mentioned Stanley, et al, U.S. Pat. No. 3,990,966, which describes, in great detail, the processing of calcite to free it from mineral impurities by the Thompson Weinman process. Briefly, in such a process, limestone ore is passed through a conduit to a grinder. After grinding, the ore is transferred to a flotation unit and the flotation agents are added to the flotation unit through a conduit. After flotation, the calcite slurry is passed to a classifier. Course rejects from the classifier are recycled to the autogenous mass for further grinding. The classified products from the classifiers are then passed through a conduit to the thickeners. Settling agents are added to the slurry in the thickeners through a conduit. The overflow from the thickeners is removed by a recycle conduit and returned to the process. The underflow slurry from the thickener is passed through a conduit to a drum or equivalent filter. After filtration, the product is passed through a conduit to a micropulverizer. The final product is bagged for shipment after ejection from the micropulverizer through a conduit.

The alkyl guanidines used in the present process are available commercially or they can be prepared using procedures well known to those skilled in the art, for example, "Organic Synthesis", Vol 1, by V. Migrdichian, pp. 407–408.

The alkyl amines used in the present process are available commercially or they can be prepared using procedures well known to those skilled in the art, for example, "Organic Synthesis", Vol. 1, by V. Migrdichian, pp. 465–466.

Illustrative of the $C_8$–$C_{24}$ alkyl groups are: octyl, decyl, lauryl, oleyl, linoleyl, stearyl, and the like. Illustrative of the alkoxyl groups are: oxyethylene, oxypropylene, oxybutylene, and the like.

The alkoxylated alkyl guanidines and alkoxylated amines are also obtained commercially or may be prepared by the reaction of alkylene oxide with the respective alkyl guanidine or alkyl amine. For example, ethylene oxide reacts readily with amines ("Chemistry of Organic Compounds", C. R. Neller, p. 690).

The amounts of alkoxylated alkyl guanidine, alkoxylated alkyl amines or combination thereof used in the present invention are conventional, typically from 0.05 to 5.0 lbs. per ton of calcite ore, preferably from 0.1 to 1.0 lb. per ton. When combinations of guanidine and amine are used, the ration thereof should range from about 95:5 to about 5:95, preferably 70:30 to 30:70, respectively.

The comparative test methods which follow in the detailed examples will show that:

(1) Ethoxylated (6 mole EO) alkyl guanidines and ethoxylated alkyl amines improve (increase) product brightness through flotation of deleterious minerals.

(2) The amine ethoxylation level was found to be important and the most efficacious response was obtained with ethoxylation levels in the 2 to 5 moles EO range.

(3) It was also possible to decrease product abrasiveness through the flotation of quartz while also improving brightness levels with the subject reagents.

(3) The use of these collector chemistries in the flotation of the deleterious minerals resulted in overall higher calcium carbonate recoveries compared to the conventional collector chemistry (imidazoline) used as a state-of-the-art standard.

DESCRIPTION OF THE PREFERRED EMBODIMENTS

The following examples are set forth for purposes of illustration only and are not to be construed as limitations on the present invention.

In order to test the effectiveness of various additives and compare them with the prior art, the following reverse flotation test procedure is utilized:

Test Procedure (i) Flotation testing is done with a bench Denver flotation machine at 800 rpm and with the 1 kg flotation cell.

(ii) The slurry % solids is 31%–600 g dry flotation feed solids and 1300 ml of tap water.

(iii) The slurry is conditioned for 2 minutes before flotation reagent addition and for 2 minutes after flotation collector addition at the desired dosage.

(iii) The air is turned on and flotation is conducted for 7 minutes (5 minutes in the very last series described). Froth is paddled off the cell slurry surface continuously throughout the 7 minute time period.

(iv) Froth and cell products are dried and the weights determined. The calcium carbonate recovery value is calculated by the weight split between the froth and cell products (assumption: all weight is as calcium carbonate values).

(v) Analyses are conducted on the cell product (concentrate) which includes % acid insolubles, brightness (Y (%)), color which is referred to as Hunter Yellowness (YI-1), and whiteness (WI).

EXAMPLES 1-3 AND COMPARATIVE EXAMPLES 1A*-1F*

The general procedure outlined above is used to evaluate an alkoxylated guanidine of the present invention and to compare them with flotation additives of the prior art. In one procedure the flotation feed is analyzed. The results are set forth in Table 1:

Table 1 is a measure of the effect of compositions on brightness and acid insolubles:

TABLE 1

| Example | Collector | Dose, lbs/ton | Recov. % | Acid Insol, % | Y (%) | YI-1 | WI |
|---|---|---|---|---|---|---|---|
| 1A* | Flotation Feed | — | — | 1.3 | 93.88 | 2.78 | 84.88 |
| 1B* | Alkazene ® | .75 | 91.1 | .52 | 95.11 | 3.10 | 85.76 |
| 1C* | Alkazene ® | 1.00 | 87.7 | .69 | 95.83 | 3.27 | 86.26 |
| 1D* | Alkazene ® | 2.00 | 68.5 | .37 | 95.30 | 3.50 | 83.97 |
| 1 | X | .25 | 82.6 | .31 | 94.83 | 3.28 | 84.29 |
| 2 | X | .50 | 72.9 | .51 | 95.79 | 2.97 | 86.48 |
| 3 | X | 1.00 | 89.4 | .47 | 95.71 | 3.17 | 85.29 |
| 1E* | BL-3 | 2.00 | 91.01 | .37 | 93.68 | 4.00 | 71.81 |

TABLE 1-continued

| Example | Collector | Dose, lbs/ton | Recov. % | Acid Insol, % | Y (%) | YI-1 | WI |
|---|---|---|---|---|---|---|---|
| 1F* | BL-3 | .125 | 82.6 | .57 | 94.83 | 3.28 | 81.31 |

*Control Example
Flotation Feed—600 g of dry calcite-containing flotation feed solids in 1300 ml of tap water
Alkazene ®—imidazoline collector produced by Rhone-Poulenc Co.
X—an ethoxylated (6 moles EO) tallow guanidine
BL-3—primary technical oleic-linoleic amine The results in Table 1 demonstrate that the ethoxylated (6 moles EO) guanidine, provides good impurity removal. Results from the tests are compared in the Table to an imidazoline collector (Alkazene ® produced by Rhone Poulenc). The data show that the ethoxylated tallow guanidine increases the product brightness. Three amines were also evaluated: BL-1, BL-2, and BL-3 which were, respectively, a primary distilled coco amine, a primary distilled oleyl amine, and a primary vegetable oil amine. BL-1 and BL-2 gave a poor flotation separation and no analyses were obtained on the flotation cell product (accordingly, they are omitted from the table). BL-3 provides, however, significant acid insolubles removal but the higher brightness levels achieved with Alkazene ® and the ethoxylated tallow guanidine are not achieved. Additionally, the ethoxylated tallow guanidine provides a significant acid insolubles decrease.

EXAMPLE 4 AND COMPARATIVE EXAMPLE 4A*

The general procedure set forth above is repeated, to compare the results of using an alkoxylated guanidine according to the present invention and an imidazoline of the current state of the art. In Table 2 are set forth the mineral analyses of the residual froth products:

TABLE 2

| Example | Collector, dose lb./ton | % of Insolubles Floated | | |
|---|---|---|---|---|
| | | Chlorite | Mica | Quartz |
| 4 | X, 1.0 | 17 | 16 | 67 |
| 4A* | Alkazene ®, 0.75 | 27 | 43 | 30 |

The data in Table 2 obtained after use of doses of 0.75 lb./ton of Alkazene ® and 1.0 lb./ton of ethoxylated tallow guanidine (X) of Example 1 show that the latter provides superior quartz flotation while also being an effective collector for chlorite and mica in this system.

EXAMPLES 5, 6 AND COMPARATIVE EXAMPLES 5A*-6B*

The general procedure described above is repeated with lower dosages of the ethoxylated tallow guanidine of Example 1 and compared with the state-of-the-art imidazoline and with four additional amine collectors, BL-3 to -5, inclusive. The results are set forth in Table 3, as follows:

TABLE 3

| Example | Collector, Dose, lb./ton | Recov., % | % Acid Insol. | Y (%) | YI-1 | WI |
|---|---|---|---|---|---|---|
| 5 | X, .10 | 85 | .45 | 94.00 | 3.19 | 83.5 |
| 6 | X, .25 | 95 | −.07 | 94.67 | 2.75 | 85.7 |
| 5A* | Alkazene ®, .25 | 85 | −.02 | 94.66 | 2.98 | 84.9 |
| 6A* | Alkazene ®, .50 | 73 | .10 | 94.88 | 2.38 | 86.9 |
| 5B* | BL-3, .125 | 91 | .45 | 93.46 | 2.97 | 83.8 |
| 6B* | BL-3, .25 | 83 | .50 | 92.93 | 4.48 | 78.7 |
| 5C* | BL-4, .25 | 97 | 1.28 | 93.15 | 3.37 | 82.2 |

TABLE 3-continued

| Example | Collector, Dose, lb./ton | Recov., % | % Acid Insol. | Y (%) | YI-1 | WI |
|---|---|---|---|---|---|---|
| 6C* | BL-4, .50 | 97 | .67 | 93.41 | 3.00 | 83.5 |

*Control Example
BL-3—primary vegetable oil amine
BL-4—distilled dimethyl oleic-linoleic tertiary amine The results given in Table 3 demonstrate the efficacy of the ethoxylated tallow guanidine. The tests with BL-3 and BL-4 show undesirably higher acid insolubles and lower brightness levels when compared to either the ethoxylated tallow guanidine or Alkazene ®. Also evaluated as collectors were two amines, BL-5 and BL-6 (which were distilled dimethyl stearyl tertiary amine and N-90% benhenyl-arachidyl 1,3 propylenediamine, respectively). The visual results were poor and no analyses were obtained from tests with these two amine products. (Accordingly, they are omitted from Table 3).

It should be noted that the following observation was also made. Ethoxylated tallow guanidine, at dosages below 1.0 lb./ton generally benefitted from the use of a frother (polypropylene glycol) to produce sufficient froth volume to effect a separation. A frother will not benefit the imidazoline. Because the frothing of alkoxylated alkyl guanidines is regulated fairly independently of collector, increased control of the metallurgical results is possible with the compounds of the present invention.

EXAMPLES 7-13 AND COMPARATIVE EXAMPLE 7A*

The procedure above is repeated to re-evaluate the alkoxylated alkyl guanidines of this invention and to compare them with alkoxylated alkyl amines of the present invention and the imidazoline of the current usage. The results are set forth in Table 4 as follows:

TABLE 4

| Example | Collector, Dose, lb./ton | Recov., % | % Acid Insol. | Y (%) | YI-1 | WI |
|---|---|---|---|---|---|---|
| 7A* | Alkazene ®, .60 | 86.2 | .04 | 94.99 | 3.51 | 84.0 |
| 7 | X, .40 | 90.8 | .09 | 94.77 | 3.02 | 85.2 |
| 8 | Y, .20 | 84.7 | 1.40 | 93.34 | 2.86 | 84.1 |
| 9 | Z, .20 | 96.5 | 1.54 | 93.32 | 3.09 | 83.4 |
| 10 | W, .20 | 91.9 | 1.12 | 93.01 | 3.79 | 81.3 |
| 11 | Q, .20 | 95.5 | .25 | 94.24 | 2.77 | 85.4 |
| 12 | R, .20 | 86.4 | .022 | 94.90 | 3.16 | 84.9 |
| 13 | R, .40 | 87.4 | .01 | 94.82 | 3.19 | 84.7 |

*Control Example
Y—Ethoxylated (15 mole EO) tallow amine
Z—Ethoxylated (10 mole EO) stearic amine
W—Ethoxylated (8 mole EO) tallow amine
Q—Ethoxylated (5 mole EO) oleyl amine
R—Ethoxylated (2 mole EO) oleyl amine Table 4 demonstrates that ethoxylated alkyl amines (Examples 8-13) are effective for calcium carbonate impurity removal. Additionally, the trends established in the tests demonstrate show that higher levels of ethoxylation are less preferable than lower because they achieve a somewhat less-effective separation. In essence, ethoxylation levels of 2 to 5 moles EO are preferred because of the better results obtained with the oleyl based amines. Also, the high efficiency of the ethoxylated alkyl guanidine, X, is again demonstrated. Based on results with aliphatic primary and diamine reagents of various chemistries, set forth in the earlier comparative examples, some ethoxylation appears necessary to achieve an effective flotation separation of impurities from calcium carbonate using fatty amine-based amines.

EXAMPLE 8

When the procedure of the above Example 1 is repeated, substituting a 50:50 wt/wt ratio of the ethoxylated tallow guanidine and ethoxylated (5 moles EO) oleyl amine, substantially the same results are obtained. "EO" means derived from ethylene oxide.

EXAMPLE 9

When the procedure of the above Example 1 is repeated, substituting an alkoxylated (5 moles EO) octyl guanidine for ethoxylated tallow guanidine, substantially the same results are obtained.

EXAMPLE 10

When the procedure of the above Example 1 is repeated, substituting an alkoxylated (3 moles EO) lauryl guanidine for ethoxylated tallow guanidine, substantially the same results are obtained.

EXAMPLE 11

When the procedure of the above Example 1 is repeated, substituting an alkoxylated (3 moles PO) octyl amine for ethoxylated tallow guanidine, substantially the same results are obtained. "PO" means derived from propylene oxide.

EXAMPLE 12

When the procedure of the above Example 1 is repeated, substituting an alkoxylated (2 moles EO) stearyl amine for ethoxylated tallow guanidine, substantially the same results are obtained.

EXAMPLE 13

When the procedure of the above Example 1 is repeated, substituting an alkoxylated (3 moles EO) dodecyl guanidine for ethoxylated tallow guanidine, substantially the same results are obtained.

EXAMPLE 14

When the procedure of the above Example 1 is repeated, substituting a 70:30 wt/wt ratio of the ethoxylated (5 moles EO) octyl guanidine and ethoxylated (5 moles PO) octyl amine, substantially the same results are obtained. "PO" means derived from propylene oxide.

EXAMPLE 15

When the procedure of the above Example 1 is repeated, substituting a 30:70 wt/wt ratio of the ethoxylated (2 moles EO) stearyl amine and ethoxylated (3 moles EO) dodecyl guanidine, substantially the same results are obtained.

The above mentioned patents, publications, and Test Methods are incorporated herein by reference.

Many variations in the present invention will suggest themselves to those skilled in this art in light of the above, detailed description. All such obvious modifications are within the full intended scope of the appended claims.

We claim:

1. In the reverse flotation process for purifying calcite ore, calcite rougher or calcite concentrate whereby finely ground particles thereof are contacted with a flotation agent and floated to remove quartz, micaceous minerals, chlorite, pyrite and other mineral impurities, the improvement which comprises using a flotation agent consisting essentially of a compound selected from the group consisting of an alkoxylated $C_8$–$C_{24}$ alkyl guanidine containing 1–10 alkoxy groups, an alkoxylated $C_8$–$C_{24}$ alkyl fatty amine containing 1–6 alkoxy groups and mixtures thereof.

2. The process according to claim 1 wherein the flotation agent is an alkoxylated $C_8$–$C_{24}$ alkyl guanidine.

3. The process according to claim 2 wherein the flotation agent is an alkoxylated $C_{12}$–$C_{18}$ alkyl guanidine.

4. The process according to claim 3 wherein the flotation agent is an ethoxylated $C_{12}$–$C_{18}$ alkyl guanidine.

5. The process according to claim 2 wherein the guanidine contains 3–7 alkoxy groups.

6. The process according to claim 5 wherein the guanidine contains 6 alkoxy groups.

7. The process according to claim 6 wherein the alkoxy groups are ethoxy groups.

8. The process according to claim 1 wherein the flotation agent is an alkoxylated $C_8$–$C_{24}$ alkyl amine.

9. The process according to claim 8 wherein the flotation agent is an alkoxylated $C_{12}$–$C_{18}$ alkyl amine.

10. The process according to claim 9 wherein the flotation agent is an ethoxylated $C_{12}$–$C_{18}$ alkyl amine.

11. The process according to claim 8 wherein the amine contains 2–5 alkoxy groups.

12. The process according to claim 11 wherein the amine contains 2 alkoxy groups.

13. The process according to claim 12 wherein the alkoxy groups are ethoxy groups.

14. The process according to claim 1 wherein the flotation agent is a mixture of an alkoxylated alkyl guanidine and an alkoxylated alkyl amine.

* * * * *